US008405584B2

(12) United States Patent
Chen

(10) Patent No.: US 8,405,584 B2
(45) Date of Patent: Mar. 26, 2013

(54) DISPLAY AND THIN-FILM-TRANSISTOR DISCHARGE METHOD THEREFOR

(75) Inventor: Chi-Wen Chen, Chiayi County (TW)

(73) Assignee: AU Optronics Corp. (TW)

( * ) Notice: Subject to any disclaimer, the term of this patent is extended or adjusted under 35 U.S.C. 154(b) by 1336 days.

(21) Appl. No.: 11/474,353

(22) Filed: Jun. 26, 2006

(65) Prior Publication Data

US 2007/0052647 A1 Mar. 8, 2007

(30) Foreign Application Priority Data

Sep. 5, 2005 (TW) ..... 94130428 A

(51) Int. Cl.
*G09G 3/32* (2006.01)

(52) U.S. Cl. ..... 345/82; 345/68; 345/76; 345/77

(58) Field of Classification Search ..... None
See application file for complete search history.

(56) References Cited

U.S. PATENT DOCUMENTS 4,961,002 A * 10/1990 Tam et al. ..... 365/185.03
7,091,667 B2 8/2006 Sakaguchi et al.
2003/0015703 A1 1/2003 Yamazaki et al.
2003/0030381 A1 2/2003 Yamazaki et al.
2004/0145543 A1* 7/2004 Van Woudenberg et al. ... 345/63
2005/0067970 A1* 3/2005 Libsch et al. ..... 315/169.3
2005/0121670 A1 6/2005 Lee et al.
2009/0142868 A1 6/2009 Lee et al.

FOREIGN PATENT DOCUMENTS

JP 3-50731 3/1991
JP 2000-267597 A 9/2000
JP 2002-221937 8/2002
JP 2005-107129 4/2005
JP 2005-174931 6/2005
TW I238526 8/2005

* cited by examiner

*Primary Examiner* — Sumati Lefkowitz
*Assistant Examiner* — Jesus Hernandez
(74) *Attorney, Agent, or Firm* — Bacon & Thomas, PLLC

(57) ABSTRACT

A display and the thin-film-transistor discharge method therefore are used for providing a dual-gate thin film transistor to drive the electroluminescent element to emit light. While the thin film transistor (TFT) is discharged, an electric field is formed between the top-gate and the bottom-gate. The electric field is for improving the electric discharge effect at the channel of the TFT, and the magnitude of the applied electric field corresponds to the magnitude of the pixel voltage.

17 Claims, 6 Drawing Sheets

DISPLAY AND THIN-FILM-TRANSISTOR DISCHARGE METHOD THEREFOR

This application claims the benefit of Taiwan application Serial No. 94130428, filed Sep. 5, 2005, the subject matter of which is incorporated herein by reference.

BACKGROUND OF THE INVENTION

1. Field of the Invention

The present invention relates in general to an electroluminescent display, and more particularly, to a thin-film-transistor discharge method.

2. Description of the Related Art

Normally, the pixels of organic light emitting display use a thin film transistor (TFT) incorporated with a capacitor to store signals for controlling the luminance of organic light emitting diode (OLED).

When the above TFT is manufactured according to amorphous silicon (a-Si) manufacturing process, a discharge process could be included during the driving process so as to prolong the TFT lifespan and maintain the image quality. However, the conventional discharge method can only apply the same operating voltage to each TFT during the discharge process. Consequently, part of the TFT would be either over discharged or under discharge. Furthermore, the conventional discharged method is unable to effectively recover the channel within the TFT. Therefore, the above problems would cause display quality of organic light emitting display to be deteriorated.

Therefore, how to solve the problem described above to improve the display quality has become an imminent challenge to be resolved.

SUMMARY OF THE INVENTION

It is therefore an object of the present invention to provide a display and the thin-film-transistor discharge method therefore capable of applying different operating voltages according to the deterioration of each pixel so as to achieve different discharge effects and reduce the influence of the deterioration of the TFT. High display quality can be therefore achieved in the invention.

The present invention achieves the above-identified object by providing a method for discharging a thin-film-transistor (TFT) in at least one pixel. The pixel comprises an electroluminescent element and a thin-film-transistor (TFT) which owns a first gate and a second gate. A terminal of the electroluminescent element is electrically connected to the source/drain of TFT. The thin-film-transistor discharge method is disclosed below. A first voltage and a second voltage are respectively provided to the first gate and the second gate of the TFT, so that the first voltage difference between the first voltage and the second voltage controls the magnitude of the current flowing through the TFT. A third voltage, a fourth voltage, and a fifth voltage are respectively provided to the second gate of the TFT, the source/drain of TFT and another terminal of the electroluminescent element, so that the second voltage difference between the third voltage and the first voltage, the fourth voltage, and the fifth voltage enable discharge of the TFT.

The present invention achieves the above-identified object by providing a display. The display comprises a pixel array, a data driving circuit and a driving circuit. The pixel array has at least one pixel comprising a thin-film-transistor (TFT), an electroluminescent element, and a capacitor. The TFT has a first gate and a second gate. A terminal of the electroluminescent element is electrically coupled to the source/drain of TFT. A terminal of the capacitor is electrically coupled to the first gate of the TFT. The data driving circuit is electrically connected to the first gate for providing the first voltage or the pixel voltage to the first gate. The driving circuit is electrically connected to the second gate.

Other objects, features, and advantages of the present invention will become apparent from the following detailed description of the preferred but non-limiting embodiments. The following description is made with reference to the accompanying drawings.

DETAILED DESCRIPTION OF THE INVENTION

The deterioration of each pixel corresponds to the magnitude of the pixel voltage (Vdata) received by each pixel. The present invention provides a dual-gate thin film transistor to drive the electroluminescent element to emit light, that is, the TFT has independent bottom-gate and top-gate. After the pixel voltage is received by the pixel to display accordingly, an electric field is formed between the top-gate (such as the first gate) and the bottom-gate (such as the second gate). The electric field is for improving the electric discharge effect at the channel, and the magnitude of the applied electric field is proportional to the magnitude of the pixel voltage. Besides, when the electric field is formed between the top-gate and the bottom-gate, two electric fields are respectively formed between the source and the bottom-gate and between the drain and the bottom-gate so that the TFT can be completely discharged. During the pixel display process, different discharge electric fields can be applied according to the deterioration of the luminance of each pixel. Therefore, the invention provides an electroluminescent display of higher display quality by providing a dual-gate thin film transistor formed by a-Si manufacturing process.

Figure 1:
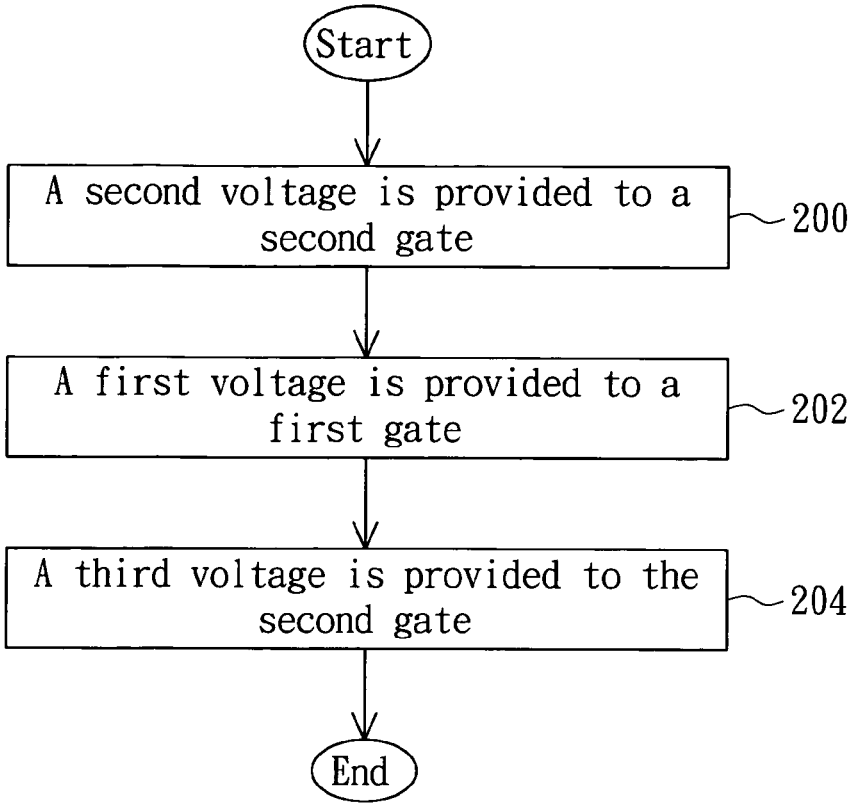
FIG. 1 is a flowchart for a thin-film-transistor discharge method according to a preferred embodiment of the present invention.

Referring to FIG. 1, a flowchart for a thin-film-transistor discharge method according to a preferred embodiment of the present invention is shown. The TFT applied to the pixels has two gates. The thin-film-transistor discharge method comprises the following steps. Firstly, the method begins at step 200, a second voltage is provided to a second gate so that TFT is turned off. Next, proceed to step 202, during the period when the TFT is turned off, a first voltage is provided to a first gate of the TFT. The first voltage is stored in a corresponding storage capacitor. The voltage level of the first voltage corresponds to the voltage level of previous pixel voltage received by the pixel. Next, proceed to step 204, when the TFT is to be discharged, a third voltage is provided to the second gate so that an electric field is formed between the second gate and the first gate. The magnitude of the electric field is proportional to the magnitude of previous pixel voltage and enables the channel to be discharged.

Figure 2:
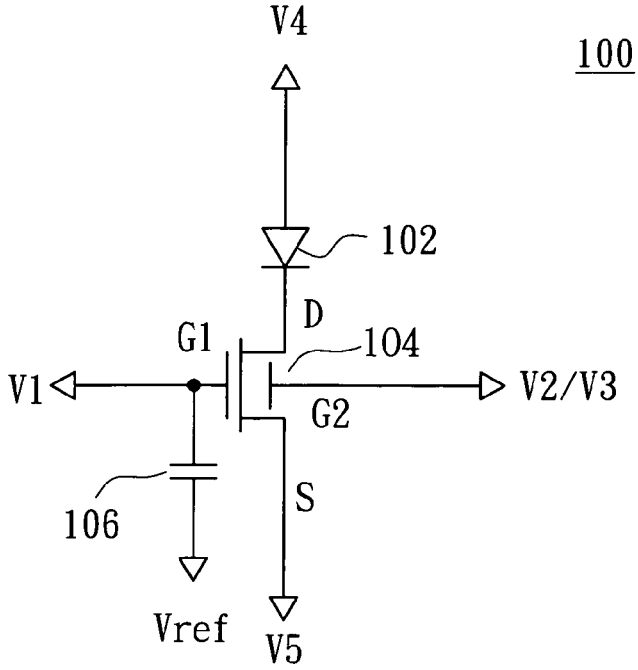
FIG. 2 is a circuit diagram for an example of pixel circuit.

Referring to FIG. 2, a circuit diagram for an example of pixel circuit is shown. The above thin-film-transistor discharge method can be applied in the pixel circuit 100 for instance. The pixel circuit 100, which can be formed by a-Si manufacturing process, comprises an electroluminescent element 102 and at least a thin film transistor (TFT) 104. The electroluminescent element 102 can be an organic light emitting diode (OLED) or a polymer light emitting diode (PLED) for instance. TFT 104 can be a dual-gate N-typed TFT for instance. The two gates are the first gate G1 and the second gate G2 respectively. The TFT 104 is incorporated with at least a capacitor to store the controlling signal for controlling the grey level of the luminance of the organic light emitting diode 102. As shown in FIG. 2, the pixel circuit 100 further comprises a storage capacitor 106. A terminal of the storage capacitor 106 is coupled to the first gate G1, while another terminal of the storage capacitor 104 is coupled to a reference voltage Vref. The negative terminal of the electroluminescent element 102 is coupled to the drain D of TFT 104.

The deterioration of each pixel corresponds to the magnitude of the pixel voltage received by each pixel, an electric field E3 (shown in FIG. 3) corresponding to the pixel voltage is formed between the first gate G1 and the second gate G2 after the pixel voltage is received and display by the pixel 100. In other words, after the pixel 100 has displayed an image, in step 200, the second voltage V2, such as −15V for instance, is provided to the second gate G2 so that the TFT 104 is turned off before the TFT 104 is discharge. In step 202, during the period when the TFT 104 is turned off, the first voltage V1 is provided to the first gate G1 and stored in the storage capacitor 104. The first voltage V1 corresponds to the magnitude of the previous pixel voltage received by the pixel 100, the pixel voltage ranges from 0V to 10V for instance. If the pixel voltage received is equal to +10V, then the first voltage V1 applied correspondingly is equal to 0V. Or, if the pixel voltage is 0V, then the first voltage V1 applied correspondingly is +10V. Next, in step 204, when the TFT 104 is to be discharged, the third voltage V3 is provided to the second gate G2. The third voltage V3 is +30V for instance. Meanwhile, the fourth voltage V4 is provided to the positive terminal of the electroluminescent element 102, and the fifth voltage V5 is provided to the source of the TFT 104. The fourth voltage V4 and the fifth voltage V5 substantially have the same voltage level, for instance, +30V.

Figure 3:
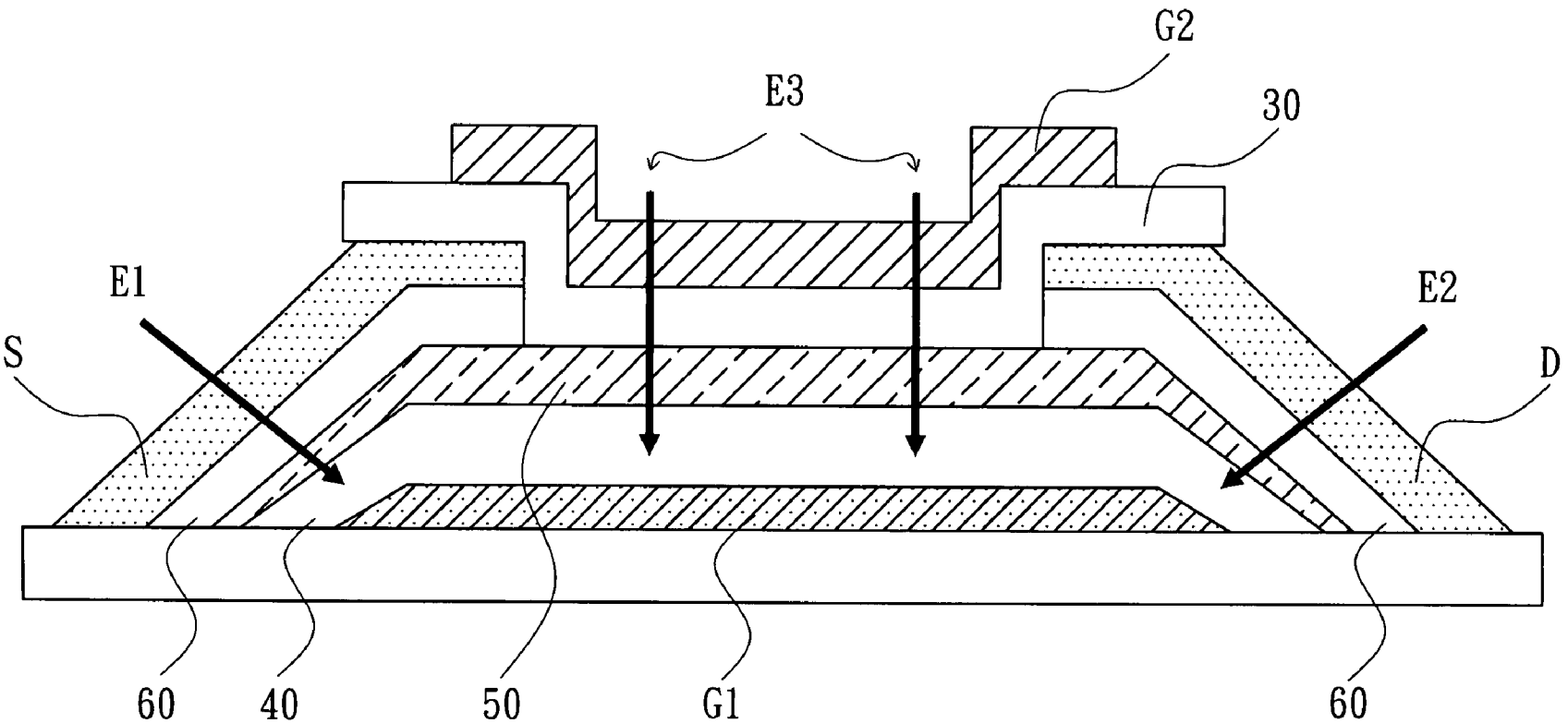
FIG. 3 shows a TFT structure when discharging.

The fourth voltage V4 and the fifth voltage V5 are for the TFT 104 to form an electric field E1 and an electric field E2 respectively between the source S and the first gate G1 and between the drain D and the first gate G1. Thus, by forming the electric fields E3, E1, E2 respectively between the third, the fourth, and the fifth voltages V3, V4, and V5 and the first voltage V1, the TFT 104 is discharged. Referring to FIG. 3, a TFT structure when discharging is shown. The TFT 104 is an electronic element comprising the bottom-gate G1, the top-gate G2, the source S, the drain D , a first isolation layer 30, a second isolation layer 40, an a-Si channel layer 50 and a heavily doped semi-conductor layer 60. From the above disclosure, it can be seen from FIG. 3 that by forming an electric field E3 between the second gate G2 and the first gate G1, the electric charges at the channel 50 are discharged. The overall discharge effect can be achieved with the electric field E1 between the source S and the first gate G1 and the electric field E2 between the drain D and the first gate G1.

Figure 4:
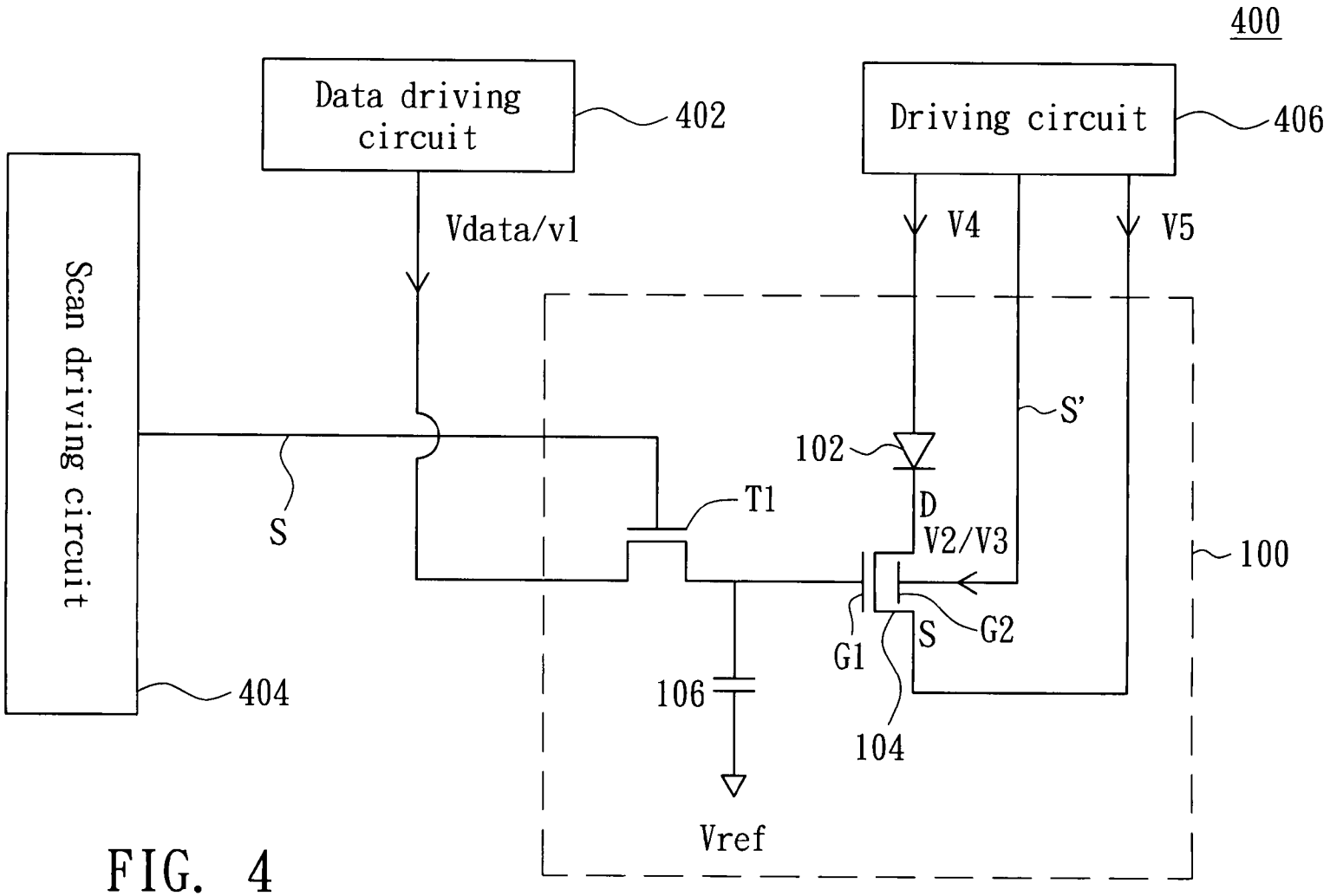
FIG. 4 is a diagram of an example of a display according to a preferred embodiment of the present invention.

Referring to FIG. 4, a diagram of an example of a display according to a preferred embodiment of the present invention is shown. Display 400 comprises a data driving circuit 402, a scan driving circuit 404, a driving circuit 406 and a pixel array. The pixel array includes a number of pixel circuits 100. FIG. 4 is exemplified by a pixel circuit 100. The pixel circuit 100 further comprises a TFT T1. The data driving circuit 402 is for outputting the pixel voltage or the first voltage V1 to the pixel circuit 100 according to RGB data. The scanning circuit 404 is for outputting the scanning signal to the TFT T1 via the scanning line S for the pixel 100 to receive the corresponding pixel voltage. The driving circuit 406 is for providing the operating voltages required for the operation of the pixel 100. Examples of the operating voltages include the fourth voltage V4 of +12V and the fifth voltage V5 of 0V when displaying an image, and the voltage levels of the second voltage V2, the third voltage V3, the fourth voltage V4 and the fifth voltage V5 during discharging. The driving circuit 406 is electrically connected to the second gate G2 of the pixel 100 via another scanning line S' or another power line for instance.

Figure 5:
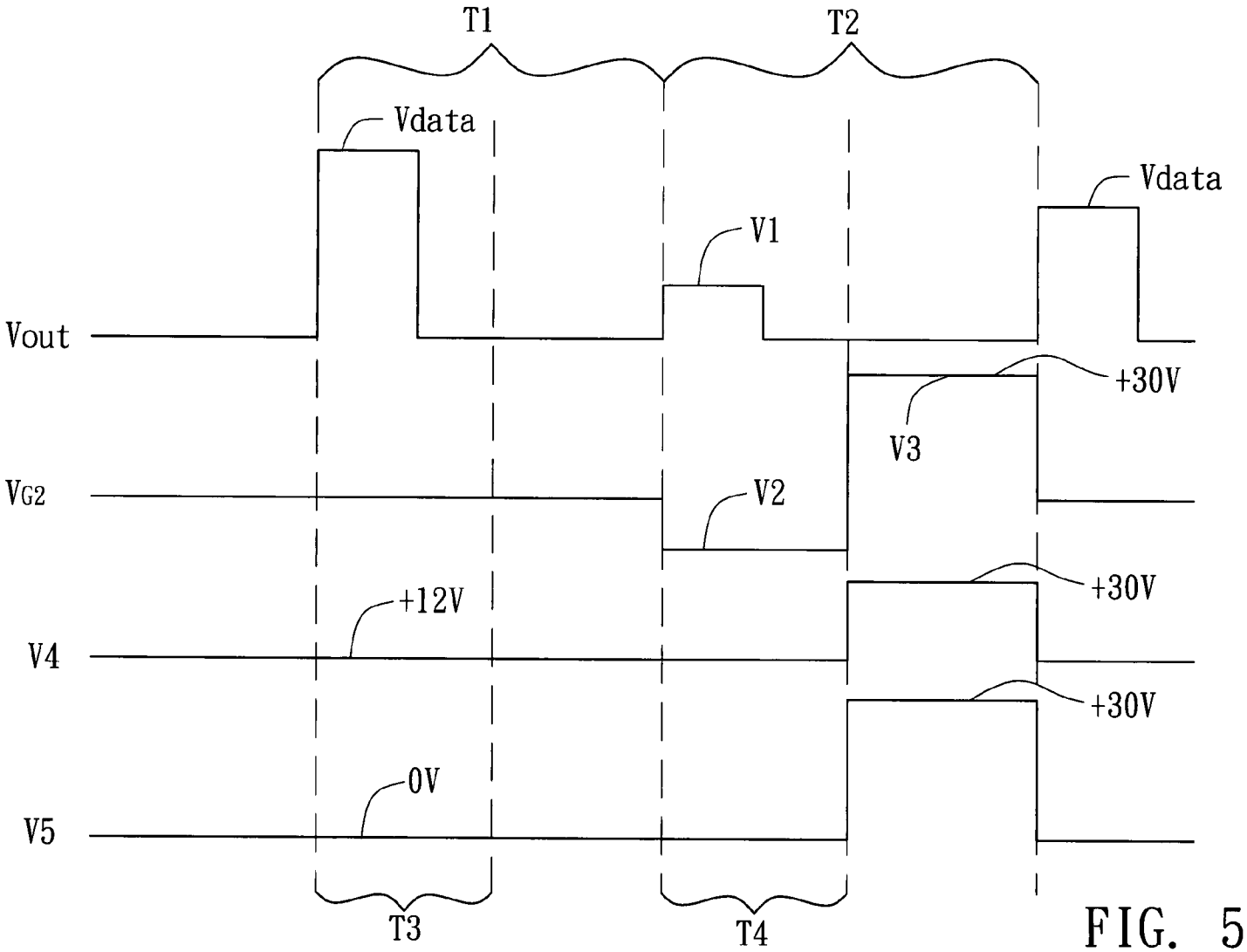
FIG. 5 is a timing diagram of the present invention.

Referring to FIG. 5, a timing diagram of the present invention is shown. The voltage Vout is the output voltage of the data driving circuit 402. The data driving circuit 402 inputs the pixel voltage Vdata to the pixel 100 within the frame period T1. Meanwhile, the fourth voltage V4 and the fifth voltage V5 are normal operating voltages, for example, the fourth voltage V4 is +12V while the fifth voltage V5 is 0V. The voltage VG2 is the voltage level at the second gate. Within the frame period T1, the voltage level of the VG2 enables the TFT 104 to be turned on.

Next, within the discharge period T2 (or called "the period of resetting TFT"), the driving circuit 406 provides the second voltage V2 of −15V to the second gate G2 for the TFT 104 to be turned off. Within the TFT termination period, that is, period T4, the data driving circuit 402 sequentially provides the first voltage V1 of each pixel 100 to corresponding pixel 100. The first voltage V1 is corresponding to the pixel voltage Vdata received by the pixel 100 in the period T1. For example, a first pixel (not shown in FIG. 4) receives a pixel voltage of +10V within the frame period T3, while a second pixel (not shown in FIG. 4) receives a pixel voltage of 0V. Next, within the TFT termination period T4, the first pixel receives a first voltage V1 of 0V, and the second pixel receives a first voltage V1 of +10V. After the TFT termination period T4, the driving circuit 406 provides a third voltage V3 of +30V at the second gate G2, and the voltage levels of the fourth voltage V4 and the fifth voltage V5 are pulled up to +30V. Therefore, during discharging, the voltage difference between the first gate G1 and the second gate G2 of the first pixel is larger than the voltage difference between the first gate Gland the second gate G2 of the second pixel. That is, the discharge effect of the first pixel is larger than the second pixel. In other words, different pixels 100 have different levels of deterioration due to receiving different pixel voltages Vdata; different first voltages V1 are provided to achieve different discharge effect. That is, different first voltages V1 are applied according to individual deterioration of each pixel 100 so to achieve different discharge effect.

Figure 6:
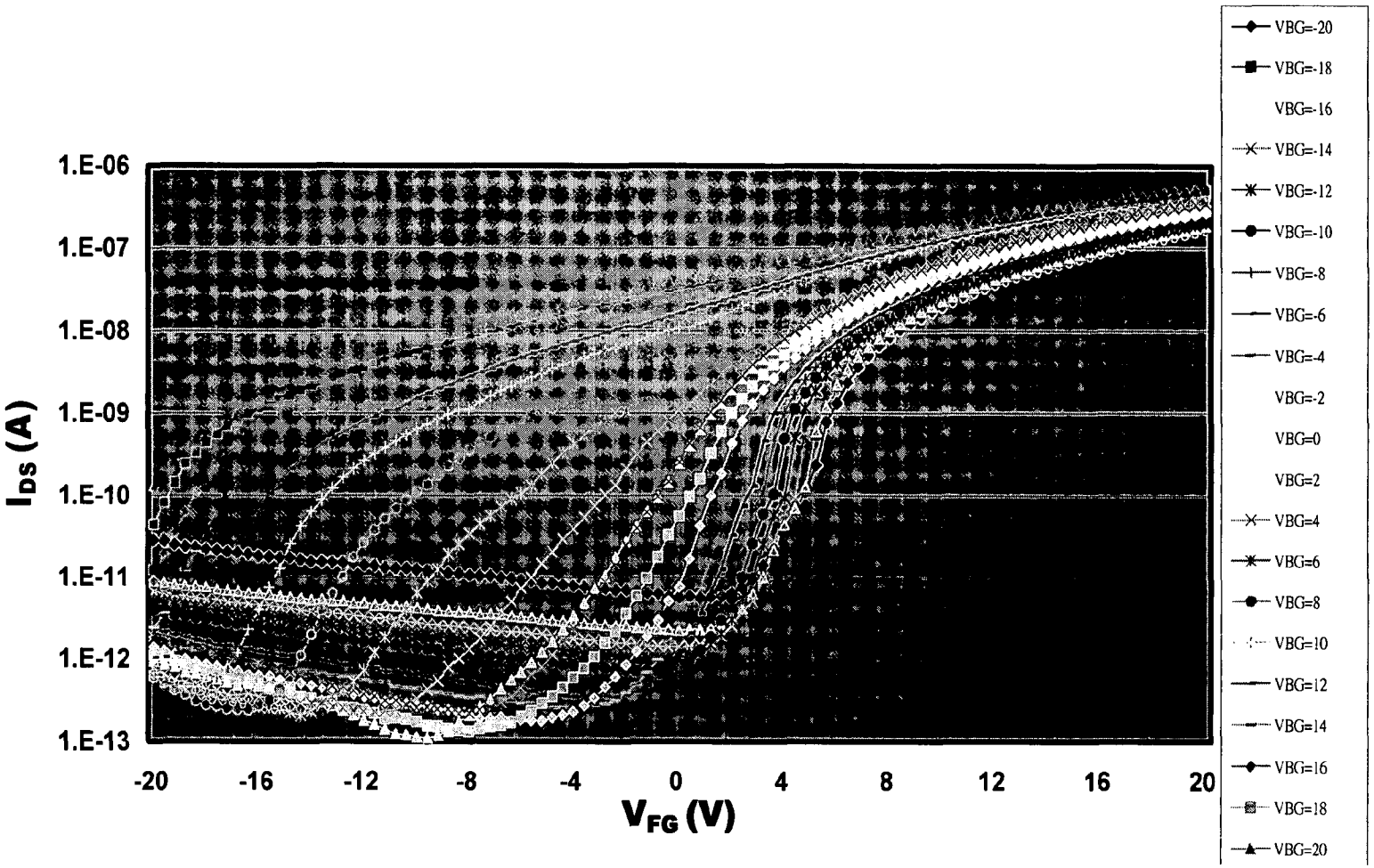
FIG. 6 is the relationship between the conducting currents and the gate voltages of a TFT.

Apart from applying different first voltages V1 according to individual deterioration of each pixel 100 so to achieve different discharge effect during the pixel display process the individual reduced luminance due to the individual deterioration of each pixel 100 can be compensated by adjusting the magnitude of the current flowing through the TFT 104 by the second gate G2. Referring to FIG. 6, the relationship between the conducting currents and the gate voltages of the TFT 104 is shown. In the diagram, the voltage level VFG and VBG is the voltage of the first gate G1 and the second gate G2, respectively. The current IDS is the current flowing through the TFT 104. During the display process, that is, the period T1, the driving circuit 406 outputs corresponding voltage level to the second gate G2 of each pixel 100 in response to the reduction in the luminance of each pixel 100, so that the magnitude of the current IDS during the display process can be adjusted.

Figure 7:
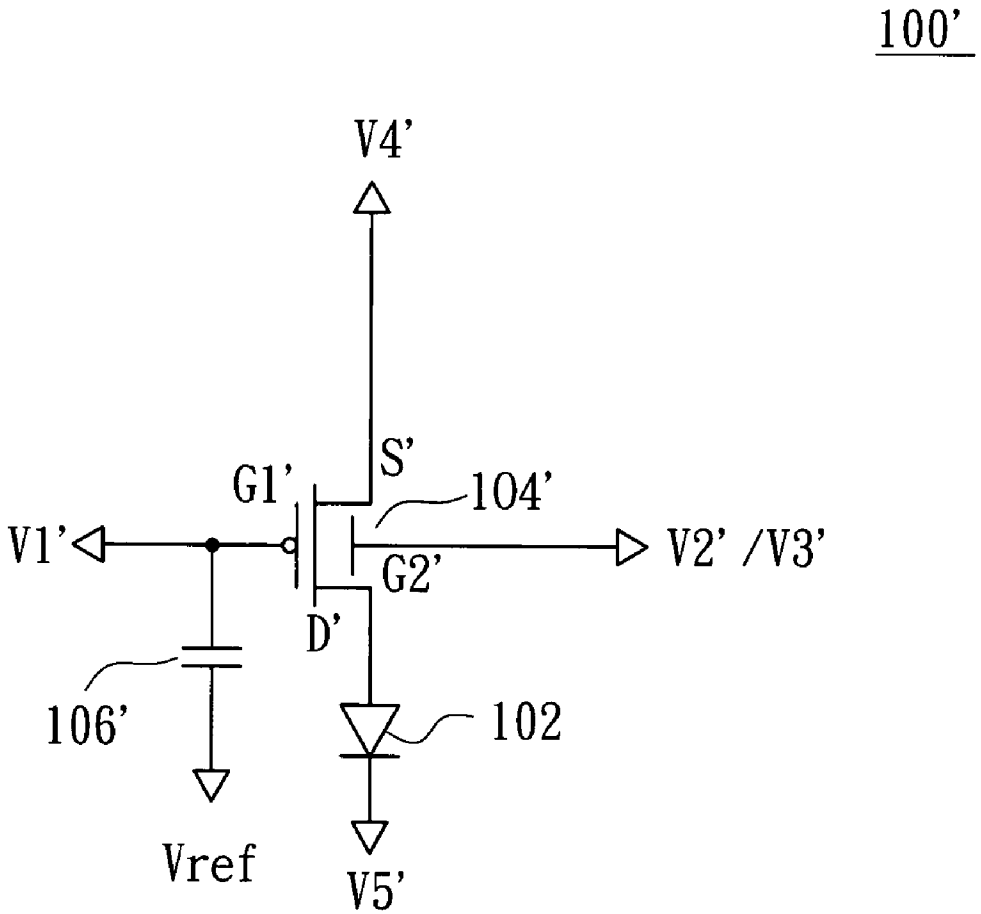
FIG. 7 is a circuit diagram of another example of pixel circuit.

In the above embodiment, the TFT 104 can be exemplified by an N-typed TFT or a P-typed TFT. Referring to FIG. 7, a circuit diagram of another example of pixel circuit is shown. The TFT 104' can be a P-typed TFT or a dual-gate TFT. The two gates respectively are the first gate G1' and the second gate G2'. The TFT 104' can also be incorporated with at least a capacitor to store the controlling signal for controlling the grey level of the luminance of the organic light emitting diode 102. A terminal of the storage capacitor 106' is coupled to the first gate G1' and another terminal of the storage capacitor 106' is coupled to a reference voltage Vref. The negative terminal of the above electroluminescent element 102 is coupled to the source S of the TFT 104'. When the TFT 104' is exemplified by a P-typed TFT, the discharge method is the same and is not repeated here. Besides, the pixel circuit 100' can be formed by a-Si manufacturing process as well as a micro-Si manufacturing process.

The display and the thin-film-transistor discharge method therefore disclosed in above embodiment of the present invention are capable of applying different operating voltages according to the deterioration of individual pixels so as to achieve different discharge effects and decrease the influence of the deterioration of the TFT. Furthermore, in response to the luminance deterioration of each pixel during the display process, the current magnitude of TFT is adjusted by the second gate to compensate for the reduced luminance so that the display quality is improved.

While the present invention has been described by way of example and in terms of a preferred embodiment, it is to be understood that the present invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for discharging a thin-film-transistor (TFT) in at least one pixel comprising an electroluminescent element having a terminal electrically connected to a source/drain of the TFT and another terminal, the method comprising:

providing a first voltage to a first gate of the TFT and a second voltage to a second gate of the TFT, so that a first voltage difference between the first voltage and the second voltage controls the magnitude of the current flowing through the TFT, wherein after display of an image is finished and before display of a next image, the second voltage turns off the TFT and during the TFT is turned off by the second voltage, in order to discharge the TFT, generating the first voltage corresponding to a pixel voltage of the displayed image; and after display of the image is finished, after the TFT is turned off and before display of the next image, providing a third voltage to the second gate of the TFT, a fourth voltage to the source/drain of the TFT and a fifth voltage to the another terminal of the electroluminescent element, so that a second voltage difference between the third voltage and the first voltage, the fourth voltage and the fifth voltage enable electric charges at a channel to be discharged from the second gate to the first gate and accordingly discharge the TFT after display of an image is finished and before display of the next image, wherein after display of the image is finished and before display of the next image, an electric field is formed between the second gate and the first gate by the third voltage and a magnitude of the electric field is proportional to a magnitude of the display image and enables the channel of the TFT to be discharged.

2. The method of claim 1, wherein the fourth voltage is substantially equal to the fifth voltage.

3. The method of claim 1, wherein the fourth voltage and the fifth voltage are different.

4. The method of claim 1, wherein the first voltage difference is substantially equal to the second voltage difference.

5. The method of claim 1, wherein the first voltage difference and the second voltage difference are different.

6. The method of claim 1, further comprising:

during display of the image, adjusting a voltage applied to the second gate of the TFT according to reduction in luminance of the pixel.

7. The method of claim 1, wherein the pixel voltage and the first voltage are outputted by a data driving circuit.

8. The method of claim 7, wherein when the voltage level of the pixel voltage is increased and the second voltage difference according to the voltage level of the pixel voltage is enlarged, so that the TFT generates corresponding discharge effect in response to the second voltage difference.

9. A display, comprising:

a pixel array having at least one pixel comprising:

a thin-film-transistor (TFT) having a first gate and a second gate;

an electroluminescent element having a terminal electrically coupled to a source/drain of the TFT and another terminal; and a capacitor having a terminal electrically coupled to the first gate of the TFT;

a data driving circuit electrically connected to the first gate for providing a first voltage or a pixel voltage to the first gate; and a driving circuit electrically connected to the second gate, for providing a third voltage to the second gate, a fourth voltage to the source/drain of the TFT and a fifth voltage to the another terminal of the electroluminescent element;

wherein after display of an image is finished and before display of a next image, the second voltage turns off the TFT and during the TFT is turned off by the second voltage, in order to discharge the TFT, the data driving circuit generating the first voltage corresponding to a pixel voltage of the displayed image;

after display of the image is finished, after the TFT is turned off and before display of the next image, a second voltage difference between the third voltage and the first voltage, the fourth voltage and the fifth voltage enable electric charges at a channel to be discharged from the second gate to the first gate and accordingly discharge the TFT after display of an image is finished and before display of the next image; and after display of the image is finished and before display of the next image, an electric field is formed between the second gate and the first gate by the third voltage and a magnitude of the electric field is proportional to a magnitude of the display image and enables the channel of the TFT to be discharged.

10. The display of claim 9, wherein during display of the image, the driving circuit adjusts a voltage applied to the second gate of the TFT according to reduction in luminance of the pixel.

11. A method for adjusting the electric characteristics of a thin-film-transistor (TFT) having a first gate and a second gate in a display, the display having at least one electroluminescent element, the method comprising:

activating the TFT within a display period, comprising;

providing a first voltage to the first gate of the TFT;

providing a second voltage to the second gate of the TFT, a first voltage difference between the first voltage and the second voltage being for controlling the magnitude of the current flowing through the TFT, and the first voltage being corresponding to a pixel voltage, wherein after display of an image is finished and before display of a next image, the second voltage turns off the TFT and during the TFT is turned off by the second voltage, in order to discharge the TFT, generating the first voltage corresponding to a pixel voltage of the displayed image; and driving the electroluminescent element to generate a corresponding luminance according to the pixel voltage; and resetting the electric characteristics of the TFT, comprising:

providing a third voltage to the second gate of the TFT;

providing a fourth voltage to a source/drain of the TFT; and providing a fifth voltage to another terminal of the electroluminescent element, so that a second voltage difference between the third voltage and the first voltage, the fourth voltage and the fifth voltage enable electric charges at a channel to be discharged from the second gate to the first gate and accordingly discharge the TFT after display of an image is finished and before display of the next image, wherein after display of the image is finished and before display of the next image, an electric field is formed between the second gate and the first gate by the third voltage and a magnitude of the electric field is proportional to a magnitude of the display image and enables the channel of the TFT to be discharged.

12. The method of claim 11, wherein the fourth voltage is substantially equal to the fifth voltage.

13. The method of claim 11, wherein the fourth voltage and the fifth voltage are different.

14. The method of claim 11, wherein the first voltage difference is substantially equal to the second voltage difference.

15. The method of claim 11, wherein the first voltage difference and the second voltage difference are different.

16. The method of claim 11, further comprising:

during display of the image, adjusting a voltage applied to the second gate of the TFT according to reduction in luminance of the pixel.

17. The method of claim 11, wherein the pixel voltage and the first voltage are outputted by a data driving circuit.

* * * * *